United States Patent [19]

Alcenius

[11] 4,098,354

[45] Jul. 4, 1978

[54] IMPACT DRIVER FOR ELECTRIC DRILL

[75] Inventor: Thomas F. Alcenius, Jackson, Mich.

[73] Assignee: Technical Research Corporation, Jackson, Mich.

[21] Appl. No.: 692,803

[22] Filed: Jun. 4, 1976

[51] Int. Cl.[2] ..... B25D 15/00

[52] U.S. Cl. ..... 173/93.5

[58] Field of Search ..... 173/93.5, 93.6

[56] References Cited

U.S. PATENT DOCUMENTS

| | | | |
|---|---|---|---|
| 1,832,123 | 11/1931 | Holland | 173/93.6 |
| 2,061,843 | 11/1936 | Meunier | 173/93.6 |
| 2,143,173 | 1/1939 | Shaff | 173/93.6 |
| 2,158,303 | 5/1939 | Pott | 173/93.6 |
| 2,476,632 | 7/1949 | Shaff | 173/93.6 |
| 2,576,851 | 11/1951 | Newman | 173/93.6 |
| 2,712,254 | 7/1955 | Schodeberg | 173/93.6 |
| 3,106,274 | 10/1963 | Madsen | 173/93.6 |
| 3,526,282 | 9/1970 | Newman | 173/93.6 |

*Primary Examiner*—Robert A. Hafer

*Attorney, Agent, or Firm*—Beaman & Beaman

[57] ABSTRACT

A rotary impact driver for converting continuous rotation to rotary impact forces, particularly suitable as an attachment for an electric drill. A hammer is supported upon the uniformly rotating input shaft by a plurality of flexible resilient elements capable of twisting about the shaft axis causing axial translation of the hammer when hammer rotation is momentarily restrained due to engagement with an anvil mounted upon an impact producing output shaft.

9 Claims, 11 Drawing Figures

IMPACT DRIVER FOR ELECTRIC DRILL

BACKGROUND OF THE INVENTION

The field of the invention relates to rotary impact drivers utilizing a rotary hammer intermittently engaging an anvil to produce a rotary impact force such as used in impact wrenches. In particular, the impact device of the invention is employed as an attachment for an electric drill.

Impact tools wherein rotary impact forces are sequentially applied to an output shaft are widely used to rotate threaded members such as wheel studs and nuts. Such rotary impact tools usually have an output shaft upon which various sizes of wrench sockets may be selectively mounted wherein the tool may be used to rotate nuts, bolts, screws, and the like.

The majority of rotary impact drive tools are operated by compressed air. However, it is known to also drive such tools by electric motors. Various types of drive mechanisms have been employed to convert the relatively uniform rotation of the motor to successively applied impacts capable of producing sufficiently high torque to accomplish the desired purpose. Such tools normally rotate an output shaft at a constant rate determined by the rate of rotation of the motor driven input shaft until the resistance to rotation of the output shaft reaches a predetermined value and, at such time, impact forces are rapidly applied to the output shaft to complete the tightening or loosening of a threaded member.

The drive mechanism for conventional motor driven impact devices may use springs, governors, centrifically operated weights, cams, etc., to convert the continuous rotation of the input shaft to the intermittent high torque rotation of the output shaft. While many known drive mechanisms are acceptable for use with air driven impact devices, such drive mechanisms as used with electric motors have not been capable of producing the higher torques often desired due the lower velocity of revolution of electric motors as compared with air motors.

To the applicant's knowledge rotary impact power driven tools presently available for both the compressed air driven type, or the electric type, are specially designed tools manufactured to be used only as rotary impact devices. Such tools are relatively expensive, and are usually only purchased for commercial use wherein the cost of such a specialized tool is justifiable. The part time or amateur mechanic does not require the use of an impact wrench or driver often enough to justify its expense. However, electric powered drills are commonly used by part time and amateur mechanics, but, to the applicant's knowledge, no attachment is available for such hand-held electric drills which is capable of permitting the drill to be used as an impact driver or impact wrench.

SUMMARY OF THE INVENTION

It is an object of the invention to provide a rotary impact drive mechanism which is of a relatively simple construction, which may be readily manufactured and assembled, and may be employed as an attachment for hand held electric drills whereby a power driven rotary impact tool may be made available to the general public at a reasonable cost.

A further object of the invention is to provide a rotary impact attachment for hand held electric drills whereby the attachment may be used with drills of ¼ inch and ⅜ inch capacity and yet produce high torques capable of tightening threaded fasteners under torque conditions beyond that manually achievable.

Another object of the invention is to provide a rotary impact tool which may be used as an attachment for hand held electric drills which is of a concise size, easily handled and packaged, and rugged and longlasting in use.

The rotary impact driver in accord with the invention consists of a casing having an input shaft extending from one end and an output shaft coaxially extending from the casing opposite end. The input shaft may be gripped within the chuck of a portable electric drill, and the output shaft includes a square drive end for receiving conventional wrench sockets. Within the casing an annular hammer mass is mounted upon the input shaft by a support member formed of a resilient material. The support member includes an anchor portion fixed to the input shaft for rotation therewith, and a hammer support portion both rotatably and axially displaceable with respect to the input shaft and axially spaced from the anchor portion and interconnected thereto by a plurality of elongated twistable elements radially spaced from the input shaft axis. The hammer mass is solely mounted upon the hammer support portion capable of axial and rotative displacement.

The hammer mass includes a dog or projection which extends from one end of the mass toward a flange defined on the output shaft. This flange includes an anvil selectively engageable by the hammer projection whereby the output shaft will be rotated by engagement between the projection and anvil. Upon the rotative resistance of the output shaft increasing the resilient members of the hammer support member begin to twist about the input shaft axis causing the distance between the hammer support and anchor portions to decrease causing axial displacement of the hammer mass sufficient to clear the hammer projection from the anvil. Disengagement of the hammer projection and anvil permits the hammer to rapidly rotate approximately 90° and, during such rotation the original axial position of the hammer mass is restored and the projection again engages the anvil mounted on the output shaft. This cyclic operation continues whereby impact forces are rapidly imparted to the anvil and output shaft for creating a high torque by means of impact forces. The initial axial position of the hammer mass is restored by biasing means tending to separate the two portions of the hammer mass support member and such action tends to "untwist" the elongated elements and radially realigns the hammer projection and anvil for the next impact.

Another feature of the invention lies in the utilization of an O-ring located within a groove adjacent the square socket drive located on the output shaft. The normal outer diameter of the O-ring is slightly greater than the distance separating opposed drive flats and a fractional force exists between a socket mounted upon the square drive and the O-ring which retains the socket thereon but permits the socket to be readily removed from the square drive when desired.

The aforementioned prerequisites of a rotary impact device in accord with the concepts of the invention have been achieved in the above described components and a long-lasting and trouble-free impact driver has been produced of a simplified construction at reasonable cost.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
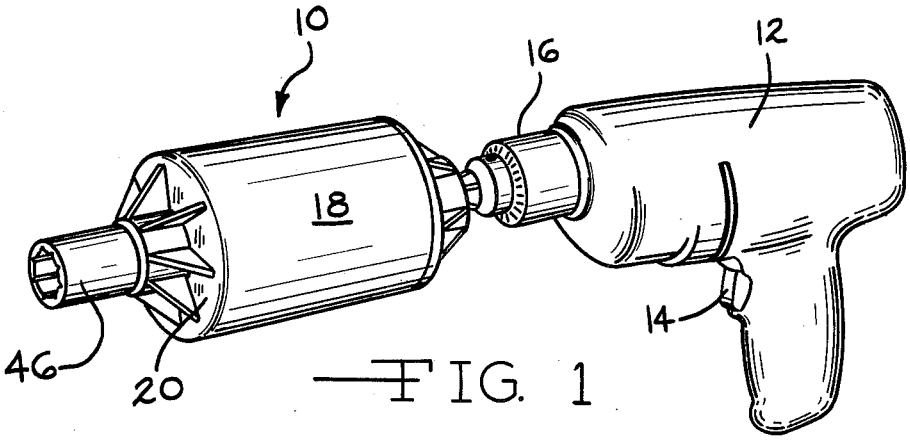
FIG. 1 is a perspective view of a rotary impact attachment in accord with the invention as shown chucked to a portable electric drill.

In FIG. 1 the arrangement is illustrated of an impact driver in accord with the invention as connected to a portable electric drill. The impact driver attachment is indicated at 10, while the electric drill is generally represented at 12 and includes the usual trigger switch 14 and chuck 16. The impact driver attachment consists of a cylindrical casing 18 having a closed end wall 20 and a removable end wall 22 attached to the casing by screws, not shown.

Figure 2:
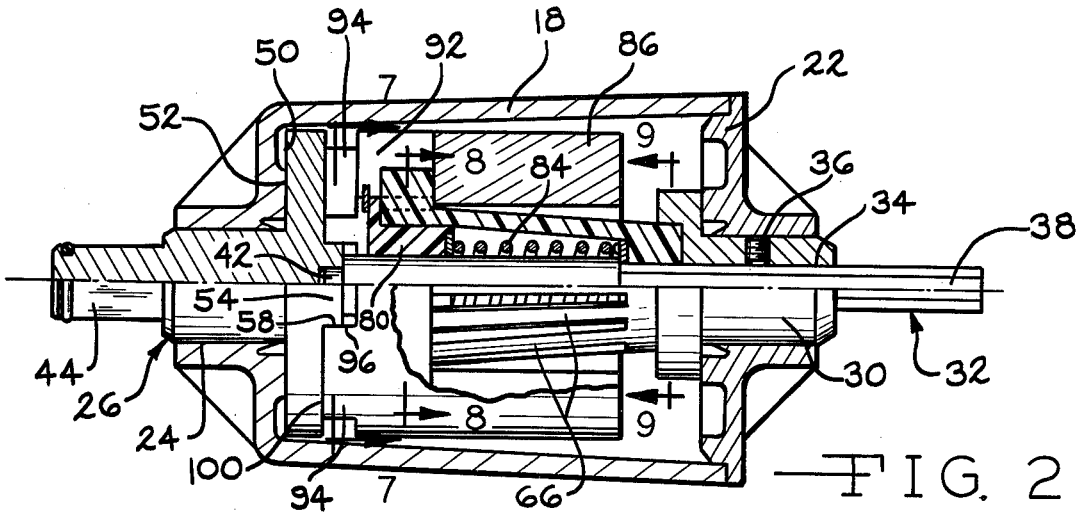
FIG. 2 is an elevational view of an attachment in accord with the invention, the lower half of the input and output shafts and the hammer mass being shown in elevation, the hammer being partially broken away to illustrate the condition of the elongated resilient elements during full engagement of the projection and anvil during impact.
Figure 3:
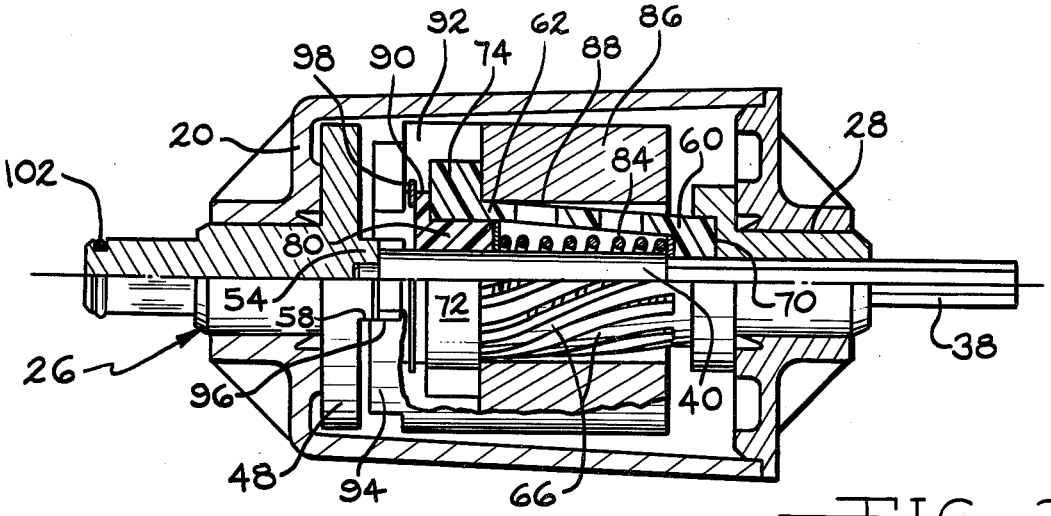
FIG. 3 is an elevational, sectional view similar to FIG. 2 illustrating the hammer projection about to disengage from the anvil.

As will be appreciated from FIGS. 2 and 3, the end wall 20 is provided with a cylindrical bore 24 in which the output shaft 26 is rotatably mounted. The end wall 22 is likewise bored at 28 for receiving the combination bearing and drive member 30 in which the input shaft 32 is supported.

In assembled relationship, the input shaft 32 extends through a hexagonal bore 34 defined in the driver-bearing member 30 and is axially fixed therein by set screws, such as at 36. The portion 38 of the input shaft has a hexagonal cross section so as to be readily grasped by the jaws of the drill chuck 16 and the hexagonal configuration permits a high torque to be transmitted to the input shaft by the chuck and also insures a nonrotative relationship between the shaft 32 and the member 30. The portion 40 of the input shaft is cylindrical and the left end of the shaft terminates in a cylindrical stud 42 received within a bore formed in the output shaft anvil ridge.

Figure 10:
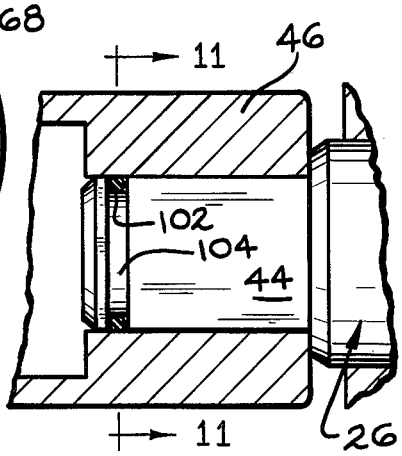
FIG. 10 is an enlarged, detail, sectional view illustrating the output shaft square drive connection utilizing the O-ring.

The output shaft 26 has an enlarged cylindrical portion for cooperation with the bore bearing surface 24 and the exterior end portion of the output shaft is formed with four flat surfaces 44 concentric to the axis of the output shaft defining a square drive for wrench sockets, such as shown at 46, FIGS. 1 and 10. The inner end of the output shaft 26 is provided with a circular radial flange 48 having a radial surface 50 which engages thrust bearing surface 52 defined on the end wall 20. The flange 48 also includes a diametrically extending ridge 54, FIG. 7, in which the bore-receiving stud 42 is defined, and the ridge includes spaced surfaces 56 and 58 disposed at right angles to the plane of he flange.

Figure 5:
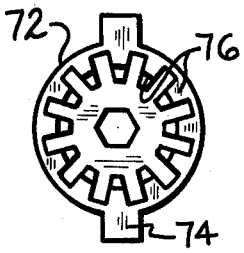
FIG. 5 is an end view of the hammer support as taken from the left of FIG. 4.
Figure 4:
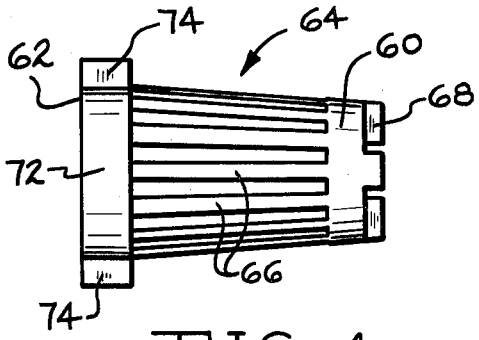
FIG. 4 is an elevational view of the hammer mass support member, per se.
Figure 6:
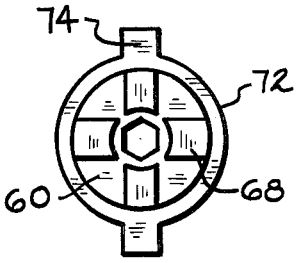
FIG. 6 is an end view of the hammer support as taken from the right of FIG. 4.

The support member 64 for the hammer is mounted upon the input shaft 32 and this support consists of a synthetic plastic member which is formed of two parts for purpose of manufacture and assembly. The support member outer portion is shown in FIGS. 4–6 and includes an anchor portion 60 and a hammer mass support portion 62 axially spaced with respect to the anchor portion. The portions 60 and 62 are homogeneously interconnected by a plurality of elongated resilient elements 66 which are capable of being twisted upon relative angular rotation occurring between the portions.

Figure 9:
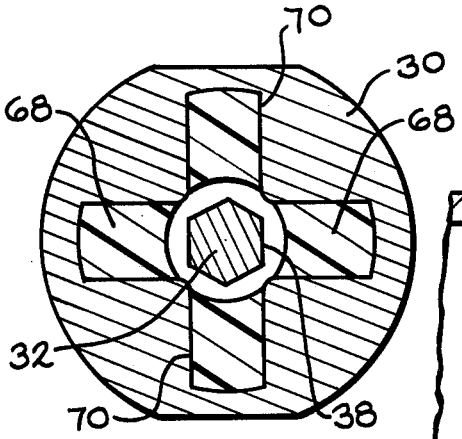
FIG. 9 is an enlarged, detail, sectional elevational view taken through the hammer support drive mechanism and input shaft bearing assembly along section 9—9 of FIG. 2.

The anchor portion 60 is provided with a hexagonal bore for closely receiving the input shaft portion 38 and the end of the portion is provided with four radially extending drive lugs 68 which are received within complimentary shaped recesses 70 formed in the flange of the driver-bearing member 30, FIG. 9. In this manner the anchor portion 60 is locked to the input shaft 32 for rotation therewith.

Figure 8:
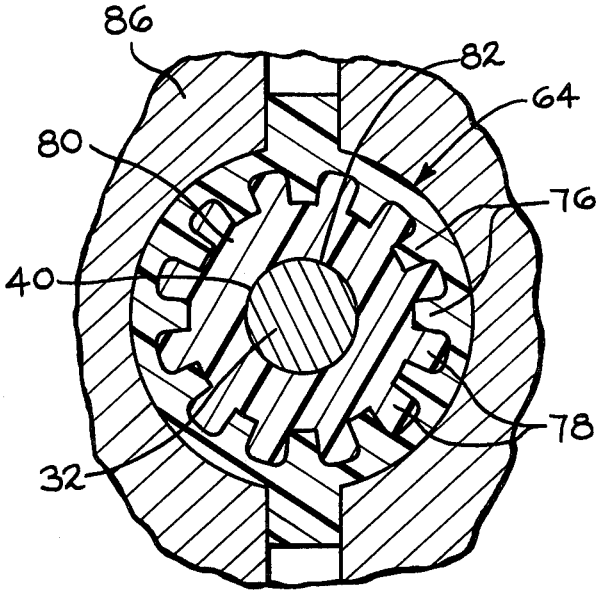
FIG. 8 is an enlarged, detail, sectional view taken through the hammer support along section 8—8 of FIG. 2.

The hammer support portion 62 is provided with an outer cylindrical surface 72 from which extends a pair of radial ears 74, FIG. 5, for establishing a driving connection with the hammer, as will be later described. The internal surface of the portion 62 is formed with a plurality of splines 76, FIG. 5, which cooperate with the splines 78 of a synthetic plastic hub member 80, FIGS. 2 and 8, which forms the support member inner portion. The hub includes a cylindrical bore 82 which is only slightly greater in diameter than the diameter of the input shaft portion 40 and the hub is located within the portion 62 in radial alignment with surface 72 and ears 74. The hub 80 prevents radial collapse of the portion 62 and permits the assembly of the compression spring 84 between the portions 60 and 62.

The hammer 86 consists of an annular mass having an internal diameter bore 88 of sufficient radius to receive the elements 66 therein and also includes a concentric bore 90 which closely receives the surface 72 such that the hammer will be concentrically related to the input shaft 32. At the left end of the hammer mass, as viewed in FIG. 2, a pair of radial notches 92 are defined, FIG. 7, for closely receiving the ears 74 whereby relative rotation between the support portion 62 and the hammer mass 86 is prevented. Further, the same end of the hammer mass is provided with a pair of pie-shaped projections or dogs 94 which extend axially from the hammer mass end and are normally in radial alignment with the anvil ridge 54. The projections 94 are diametrically related to each other and are each defined by abutment surfaces 96, FIG. 7.

Figure 7:
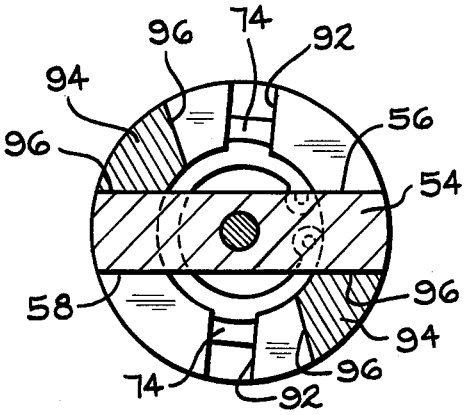
FIG. 7 is an elevational, sectional view taken through the hammer projections and anvil along section 7—7 of FIG. 2.

In assembly, the hammer mass 86 is mounted upon the support portion 62 by means of a snap ring 98 received within a groove formed in the hammer mass and overlying the outer end of the hub 80, FIGS. 2 and 7. Also, the compression spring 84 is located between a washer engaging the support anchor portion 60 and a washer engaging the inner end of the hub 80. Thus, the compression spring 84 tends to bias the hub and portion 62 away from the anchor portion 60, and this biasing force, in conjunction with the axial biasing force produced by the resilient nature of the material of the elements 66 tends to maintain the elements 66 in a linear configuration as show in FIGS. 2 and 4.

In the normal "at rest" relationship of the components of the impact driver, and, assuming that the projections 94 are not in axial alignment with the anvil ridge 54, the projections 94 will be in radial alignment with the anvil surfaces 56 and 58 and the outer end surfaces of the projections will be engaging the inner surface 100 of the flange 48. As will be appreciated from FIG. 2, the axial dimension of the projections 94 is substantially identical to the axial extension of the anvil ridge 54 from the flange surface 100. In this relationship the elements 66 will be of a linear configuration and of maximum axial length.

In use, after the input shaft 32 has been gripped by the jaws of the chuck 16 and a wrench socket 46 has been placed upon the output shaft square drive surfaces 44, rotation of the input shaft will impart rotation to the output shaft 26 and rotate the socket and associated threaded fastener. Such rotative movement is transmitted between the shafts through the driver-bearing member 30, anchor portion 60, elements 66, ears 74, projections 94, and anvil 54. As soon as the rotation of the hammer occurs the edges 96 of the hammer projections will engage the anvil edges 56 and 58, FIG. 7, and produce a positive rotative driving connection between the hammer and output shaft.

Upon resistance to output shaft rotation increasing, the resilient elements 66 begin to flex in a twisting manner relative to the axis of the input shaft portion 40. This flexing is illustrated in FIG. 3 and results from the fact that the input shaft 32 continues to rotate under the influence of the electric drill even though the output shaft 26 may be held stationary, or its rotation slowed relative to the rate of input shaft rotation.

As the elements 66 "twist," the portion 62 is pulled to the right, FIG. 3, toward the anchor 60 compressing the spring 84. This displacement of the portion 62 to the right also displaces the hammer mass 86 to the right causing axial displacement between the hammer projection surfaces 96 and the anvil 54, as shown in FIG. 3. When sufficient axial displacement occurs the projections 94 will "ride over" the anvil ridge 54. As soon as the projections have cleared the anvil the biasing force on the hammer support portion 62 to the left, FIGS. 2 and 3, will move the portion 62 and hammer 86 back to its original axial position, as shown in FIG. 2, radially realigning the projections 94 and anvil 54, permitting the surfaces 96, 56 and 58 to again engage, producing an impact rotation of the output shaft. As the resistance to output shaft rotation again increases, the elements 66, which have straightened out as soon as the projections 94 ride over the anvil 54, again are twisted to move the hammer 86 to the right to clear the hammer projections from the anvil and permit another impact cycle to occur. Of course, the frequency of the impact cycles varies according to the resistance of rotation of the output shaft and, while the frequency of the cycles initially may be relatively slow, the frequency substantially increases as the torque requirements of the output shaft increase.

As the axial displacement of the hammer is produced solely by the twisting and untwisting of the elements 66, such axial movement is produced by very simple mechanical structure having no noise or wear associated therewith and, as a result, the life of the impact device is unusually long as compared with conventional impact producing mechanisms.

The impact driver of the invention will produce impact torques in both directions of input shaft rotation as the functioning of the elements 66, projections 94 and anvil is identical regardless of the direction of rotation of input shaft 32. Thus, if drill 12 is reversible, threaded members engaged by the wrench socket may be selectively tightened or loosened.

It is to be appreciated that, while the support member 64 outer portion is illustrated as being molded of an single piece, the portions 60 and 62 could be separately formed of steel, for instance, interconnected by flexible members capable of "twisting" relative to the output shaft axis. For instance, multistrand cables, or other flexible members, could be employed.

Figure 11:
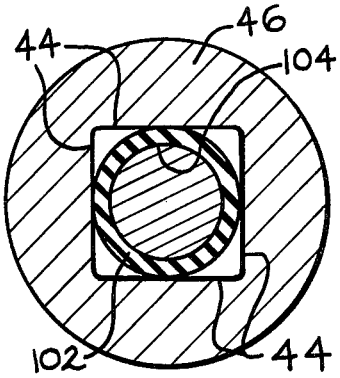
FIG. 11 is an elevational, sectional view taken along section 11—11 of FIG. 10.

In FIGS. 10 and 11 the relationship between the wrench socket 46 and the square drive on the output shaft 26 is shown wherein the O-ring 102, adjacent the end of shaft 26, is received in a groove 104. The normal diameter of the ring 102 is greater than the distance between opposed flat surfaces 44 and when a socket is placed on the drive end the O-ring is under compression imposing a frictional interconnection between the socket and the square drive output shaft. The use of the O-ring simplifies the means for maintaining the socket upon the square drive as compared with the conventional spring biased ball or detent, and after the O-ring has worn to the extent that the frictional connection reduces to become ineffective to maintain the socket on the square drive the O-ring may be easily replaced. Further, machining of the drive connection is simplified as compared with other known types of socket retainers.

It is appreciated that various modifications to the inventive concept may be apparent to those skilled in the art without departing from the spirit and scope of the invention.

I claim:

1. A rotary impact driver attachment for an electric drill comprising, in combination, a casing having first and second ends, an input shaft rotatably mounted in said casing about an axis and having a portion extending from said first end for chucking to an electric drill, an output shaft rotatably mounted in said casing coaxial with said input shaft having a wrench socket-receiving portion extending from said second end, a hammer support mounted upon said input shaft within said casing formed of a flexible resilient material, said support including an anchor portion drivingly connected to said input shaft for rotation therewith and a hammer support portion axially spaced from said anchor portion and rotatably and axially movable with respect to said anchor portion, a plurality of elongated flexible elements having ends and radially spaced from said input shaft axis homogenously formed on said hammer support, said elements connected only at their ends to said anchor and hammer support portions and being free of adjacent flexible elements and defining radially open slots between adjacent elements and capable of twisting relative to said axis to reduce the axial distance between said portions, an annular hammer solely supported upon said hammer support portion for rotation and axial movement therewith radially spaced from said input shaft axis having an axially extending projection extending toward said casing second end radially spaced from said input shaft axis, an axially extending anvil defined on said output shaft within said casing axially extending toward said projection in axial alignment therewith and radially spaced from the axis of said output shaft for intermittent engagement by said hammer projection, twisting of said elements producing the sole force for axially translating said hammer support portion and hammer to an anvil by-pass position, and biasing means axially biasing said hammer toward an anvil engaging position.

2. In a rotary impact driver attachment as in claim 1 wherein said hammer support is formed of a resilient synthetic plastic material.

3. In a rotary impact driver attachment as in claim 2 wherein said biasing means comprises the material of said hammer support.

4. In a rotary impact driver attachment as in claim 1 wherein said biasing means comprises a compression spring interposed between said anchor and support portions axially biasing said support portion away from said anchor portion.

5. In a rotary impact driver attachment as in claim 1 wherein said wrench socket receiving portion comprises four flat surfaces defining a square concentric to said output shaft, an annular groove defined in said output shaft immediately adjacent said square portion concentric to the axis of said output shaft, and a resilient O-ring received within said groove having an outer diameter slightly greater than the distance separating diametrically opposed flat surfaces, said O-ring being compressed by a wrench socket mounted on said flat surfaces and frictionally maintaining a wrench socket thereon.

6. In a rotary impact driver attachment as in claim 1 wherein said hammer support portion includes a cylindrical surface, at least one radially extending ear extending from said cylindrical surface, said hammer including a cylindrical bore mounted upon said surface, and a radial notch defined in said hammer intersecting said bore receiving said ear angularly locking said hammer and hammer support against relative displacement about the axis of said input shaft.

7. In a rotary impact driver attachment as in claim 6 wherein said hammer support portion and said elongated flexible elements are in radial alignment with said annular hammer and are circumscribed thereby.

8. In a rotary impact driver attachment as in claim 6 wherein said hammer support portion includes a hub-engaging said input shaft.

9. In a rotary impact driver attachment as in claim 1, a driver member fixed to said input shaft adjacent said casing first end, a plurality of drive recesses defined in said driver member opening toward said second end and hammer support, and a plurality of drive projections defined on said anchor portion complementary in configuration to said drive recesses and received therein drivingly connecting said anchor portion to said input shaft.

* * * * *